US011292051B2

(12) United States Patent
Zhang et al.

(10) Patent No.: US 11,292,051 B2
(45) **Date of Patent: *Apr. 5, 2022**

(54) DYNAMICALLY POSITIONED DIFFUSER FOR METAL DISTRIBUTION DURING A CASTING OPERATION

(71) Applicant: WAGSTAFF, INC., Spokane Valley, WA (US)

(72) Inventors: Bin Zhang, Liberty Lake, WA (US); Craig Lee Shaber, Liberty Lake, WA (US); Mike Anderson, Otis Orchards, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/142,810

(22) Filed: Jan. 6, 2021

(65) Prior Publication Data

US 2021/0154730 A1 May 27, 2021

Related U.S. Application Data

(63) Continuation of application No. 15/701,536, filed on Sep. 12, 2017, now Pat. No. 10,913,108.

(51) Int. Cl.
*B22D 11/103* (2006.01)
*B22D 11/049* (2006.01)
(Continued)

(52) U.S. Cl.
CPC ..... *B22D 11/103* (2013.01); *B22D 11/049* (2013.01); *B22D 11/182* (2013.01);
(Continued)

(58) Field of Classification Search
CPC ..... B22D 7/00; B22D 41/56; B22D 11/049; B22D 11/103; B22D 11/124; B22D 11/18; B22D 11/182; B21B 1/463
(Continued)

(56) References Cited

U.S. PATENT DOCUMENTS 3,425,482 A 2/1969 Capaul
3,596,804 A 8/1971 Barrow et al.
(Continued)

FOREIGN PATENT DOCUMENTS

BE 1001804 3/1990
CN 86104290 A 5/1987
(Continued)

OTHER PUBLICATIONS

U.S. Appl. No. 15/701,536, filed Sep. 12, 2017, US-2019/007018, Allowed.
International Search Report and Written Opinion for International Application No. PCT/IB2018/056947 dated Oct. 31, 2018.
Search Report for China Application No. 201880058914X dated Mar. 18, 2021 (3 pages).

*Primary Examiner* — Kevin P Kerns
(74) *Attorney, Agent, or Firm* — Alston & Bird LLP

(57) ABSTRACT

Provided herein are an apparatus and method for continuous casting of metal, and more particularly, to an apparatus and method to reduce macrosegregation through a mechanism for controlling the position of a spout tip or diffuser during the casting process to maintain the spout tip or diffuser near the solidification front, location of transition between liquid metal and solid metal in the cast part. An apparatus may include: a mold frame supporting a mold defining a mold cavity; a liquid diffuser; and an actuator configured to move at least one of the mold frame and the liquid diffuser relative to one another, wherein the actuator is configured to move at least one of the mold frame and the liquid diffuser relative to one another in response to a signal from at least one sensor.

20 Claims, 9 Drawing Sheets

(51) Int. Cl.

| | |
|---|---|
| ***B22D 11/18*** | (2006.01) |
| ***B22D 41/56*** | (2006.01) |
| *B21B 1/46* | (2006.01) |
| *B22D 7/00* | (2006.01) |
| *B22D 11/124* | (2006.01) |

(52) U.S. Cl.
CPC ..... *B22D 41/56* (2013.01); *B21B 1/463* (2013.01); *B22D 7/00* (2013.01); *B22D 11/124* (2013.01)

(58) Field of Classification Search
USPC ..... 164/151.4, 154.7, 450.3, 437, 488
See application file for complete search history.

(56) References Cited

U.S. PATENT DOCUMENTS

| | | | | |
|---|---|---|---|---|
| 4,730,660 | A | 3/1988 | Tinnes et al. | |
| 5,004,040 | A | 4/1991 | Pleschiutschnigg et al. | |
| 8,590,596 | B2 | 11/2013 | Shaber | |
| 10,913,108 | B2 * | 2/2021 | Zhang et al. ..... | B22D 11/103 |

FOREIGN PATENT DOCUMENTS

| | | | |
|---|---|---|---|
| CN | 1044911 | A | 8/1990 |
| CN | 1872457 | A | 12/2006 |
| JP | 2016185562 | A | 10/2016 |
| KR | 10 2006-0074399 | A | 7/2006 |

* cited by examiner

DYNAMICALLY POSITIONED DIFFUSER FOR METAL DISTRIBUTION DURING A CASTING OPERATION

CROSS-REFERENCE TO RELATED APPLICATIONS

This application is a continuation of and claims priority to U.S. Pat. No. 10,913,108, filed on Sep. 12, 2017, the contents of which are hereby incorporated by reference in their entirety.

TECHNOLOGICAL FIELD

The present invention relates to a system, apparatus, and method for continuous casting of metal, and more particularly, to reduce macrosegregation through a mechanism for controlling the position of a spout tip or diffuser during the casting process to maintain the spout tip or diffuser near the solidification front, location of transition between liquid metal and solid metal in the cast part.

BACKGROUND

Metal products may be formed in a variety of ways; however numerous forming methods first require an ingot, billet, or other cast part that can serve as the raw material from which a metal end product can be manufactured. One method of manufacturing an ingot or billet is through a semi-continuous casting process known as direct chill casting, whereby a vertically oriented mold cavity is situated above a platform that translates vertically down a casting pit. A starting block may be situated on the platform and form a bottom of the mold cavity, at least initially, to begin the casting process. Molten metal is poured into the mold cavity whereupon the molten metal cools, typically using a cooling fluid. The platform with the starting block thereon may descend into the casting pit at a predefined speed to allow the metal exiting the mold cavity and descending with the starting block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

The distribution of metal within the mold cavity and within the still-molten region of a cast part exiting the mold cavity is complex with changing temperature profiles and gradients throughout the casting process. Solidification physics exhibits the formation of macrosegregation whereby the cast part may have a non-uniform chemical composition across a dimension of the cast part. Macrosegregation formed from casting process is irreversible during processing of the cast part, such that it is imperative to minimize macrosegregation during the casting process.

BRIEF SUMMARY

Embodiments of the present invention generally relate to an apparatus and method for continuous casting of metal, and more particularly, to reduce macrosegregation through a mechanism for controlling the position of a spout tip or diffuser during the casting process to maintain the spout tip or diffuser near the solidification front, location of transition between liquid metal and solid metal in the cast part. Embodiments may provide an apparatus for liquid distribution into a mold cavity, the apparatus including: a mold frame supporting a mold defining a mold cavity; a liquid diffuser; and an actuator configured to move at least one of the mold frame and the liquid diffuser relative to one another, wherein the actuator is configured to move at least one of the mold frame and the liquid diffuser relative to one another in response to a signal from at least one sensor. The liquid diffuser may include a tip and define a liquid passageway there through, where the at least one sensor may include a thermocouple disposed proximate the tip of the diffuser.

According to some embodiments, the actuator includes a linear actuator, where an axis is defined through the mold cavity along which a cast part may be drawn, and the actuator is configured to move at least one of the mold frame and the liquid diffuser relative to one another along the axis. The liquid may include metal, where the tip of the liquid diffuser may be submerged in a pool of liquid metal in the mold cavity, where the relative movement between the mold frame and the liquid diffuser may result in movement of the liquid diffuser within the pool of liquid metal. The linear actuator, responsive to the signal from the thermocouple, may be configured to maintain the tip of the liquid diffuser in the pool of liquid metal at a position corresponding to a predefined temperature range of the liquid metal.

The actuator of some embodiments, responsive to the signal from the thermocouple, may be configured to maintain the tip of the liquid diffuser in a region of the pool of liquid metal near a metal coherency point during a casting operation. Embodiments may include a controller, where the controller may be configured to control the actuator and the relative position between the mold frame and the liquid diffuser where the position between the mold frame and the liquid diffuser may be established based, at least in part, on the signal from the thermocouple and at least one property of a liquid dispensed by the diffuser. The at least one property of a liquid may include a liquidus temperature of the liquid being dispensed at a given pressure.

Embodiments of the present invention may provide a method including: receiving an indication of a material to be cast in a mold cavity; establishing from the indication of the material type, a temperature profile of the material type; dispensing the material in liquid form through a diffuser into the cavity of the mold; detecting a temperature of a tip of the diffuser within the cavity of the mold; and moving at least one of the diffuser or the mold relative to the other responsive to the tip of the diffuser to maintain the tip of the diffuser within a pool of the material in liquid form based on a predefined temperature range associated with the temperature profile. Embodiments may include controlling a flow of the material through the diffuser in response to one or more properties of the pool of material.

Methods of example embodiments may optionally include: determining, based on material type, an initial position of the diffuser relative to the cavity of the mold; and moving at least one of the diffuser or the mold relative to the other to the initial position before dispensing material through the diffuser. Methods may include moving at least one of the diffuser or the mold relative to the other from the initial position to a secondary position based on an algorithm associated with the material type after the material has started to be dispensed from the diffuser and casting is occurring at a steady state. Methods may optionally include moving at least one of the diffuser or the direct chill mold relative to the other from the secondary position to a tertiary position based on the algorithm associated with the material type in response to an indication that the casting is ending.

The mold may be a direct chill mold including a starting block where the method may include moving the starting block relative to the mold cavity and the diffuser.

Embodiments described herein may provide an apparatus including: a frame; at least one mold cavity attached to the frame, the mold cavity defining an axis along which a material cast in the mold exits the mold in a continuous casting process; and a frame support, where the frame is attached to the frame support by an actuator configured to move the frame and the mold cavity relative to the support arm along an axis parallel to the axis defined by the mold cavity. The actuator may include at least one of a worm gear, a linear actuator, a hydraulic piston, or a ball screw. The apparatus may include a casting liquid distribution diffuser, where the casting liquid distribution diffuser is held fixed relative to the frame support, and where the actuator is configured to move the mold cavity relative to the casting liquid distribution diffuser.

According to some embodiments, the apparatus may include a thermocouple attached to the casting liquid distribution diffuser, where the actuator moves the frame relative to the casting liquid distribution diffuser responsive to a signal from the thermocouple. Embodiments may include a controller, where the controller is configured to cause the actuator to move the frame relative to the casting liquid distribution diffuser responsive to the signal from the thermocouple according to a temperature profile of a casting liquid dispensed from the casting liquid distribution diffuser.

Embodiments of an apparatus may include a memory configured to store a plurality of profiles, each profile including a casting material and a mold configuration, and a controller configured to move the frame and the mold cavity relative to the support arm based on a selected profile between at least two different positions during a casting operation. Embodiments may include a diffuser for dispensing liquid into the mold cavity, and a thermocouple on the diffuser, where the controller is configured to adjust the selected profile and change the position of the frame and the mold cavity relative to the support arm in response to a signal received from the thermocouple.

BRIEF DESCRIPTION OF THE DRAWINGS

Figure 1:
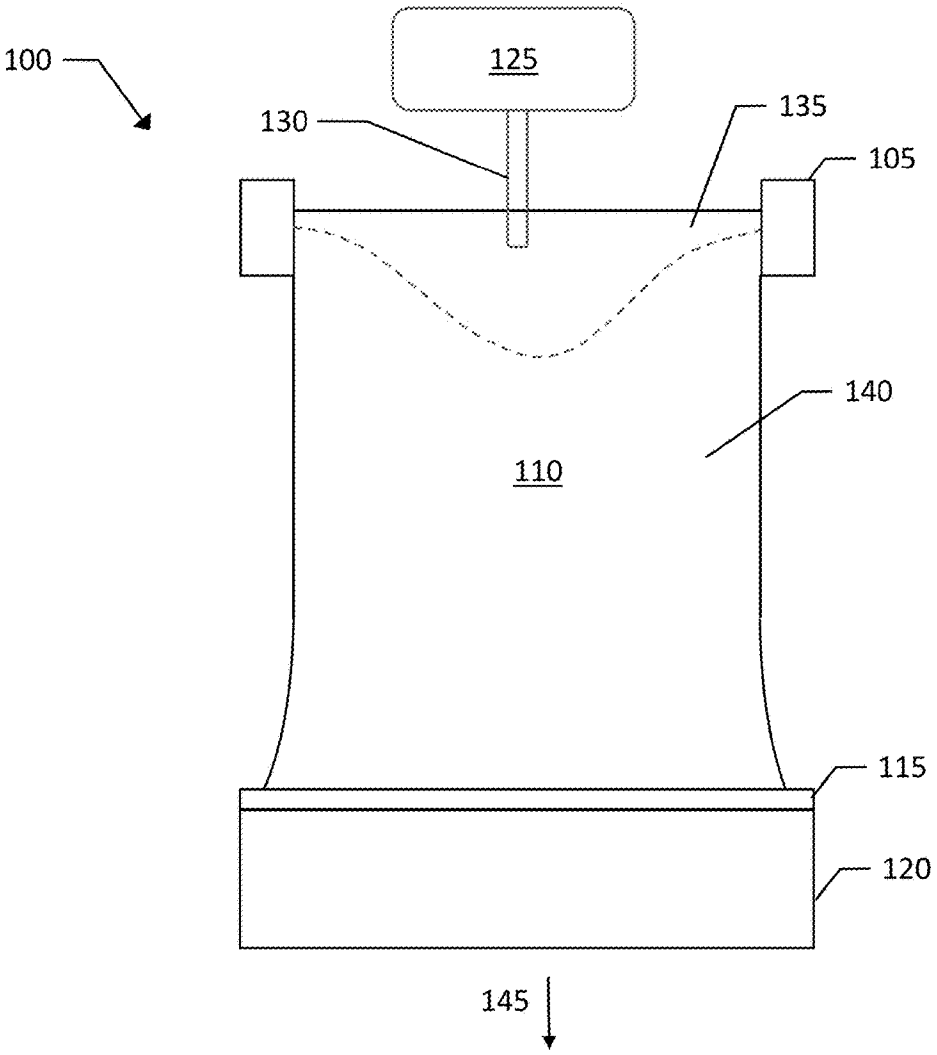
FIG. 1 (PRIOR ART)
Figure 2:
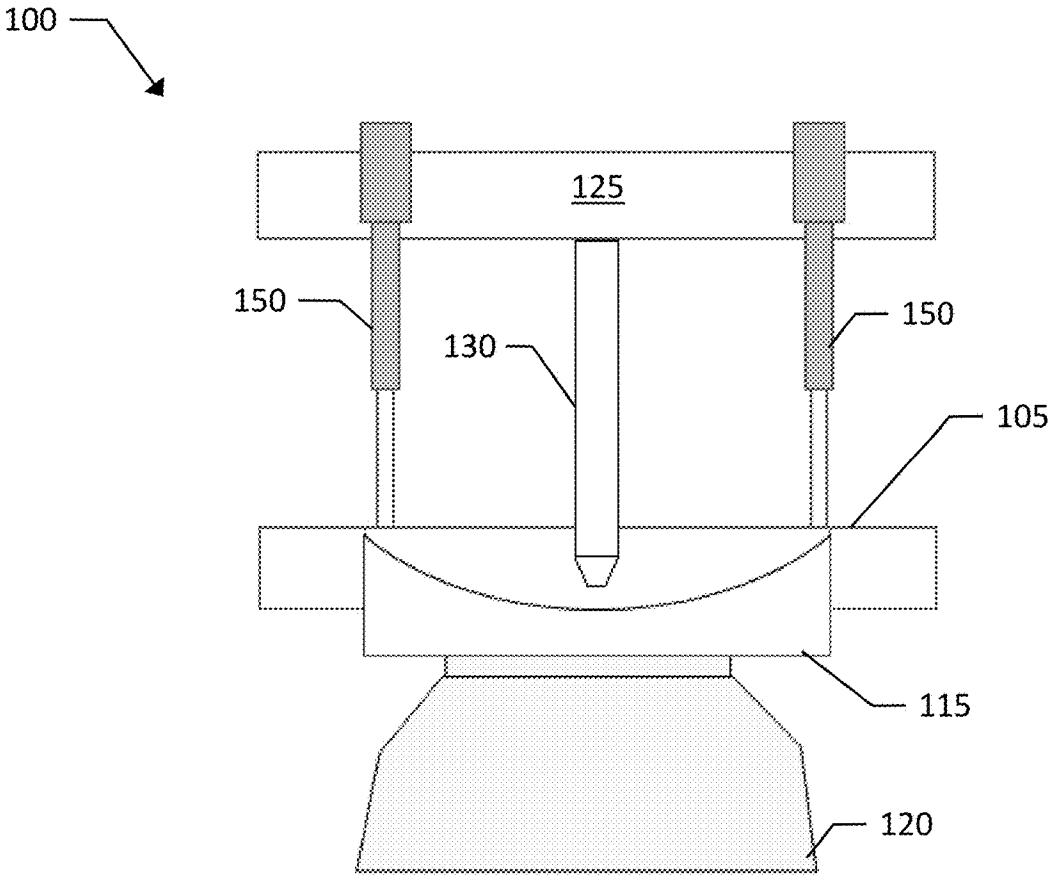
Figure 3:
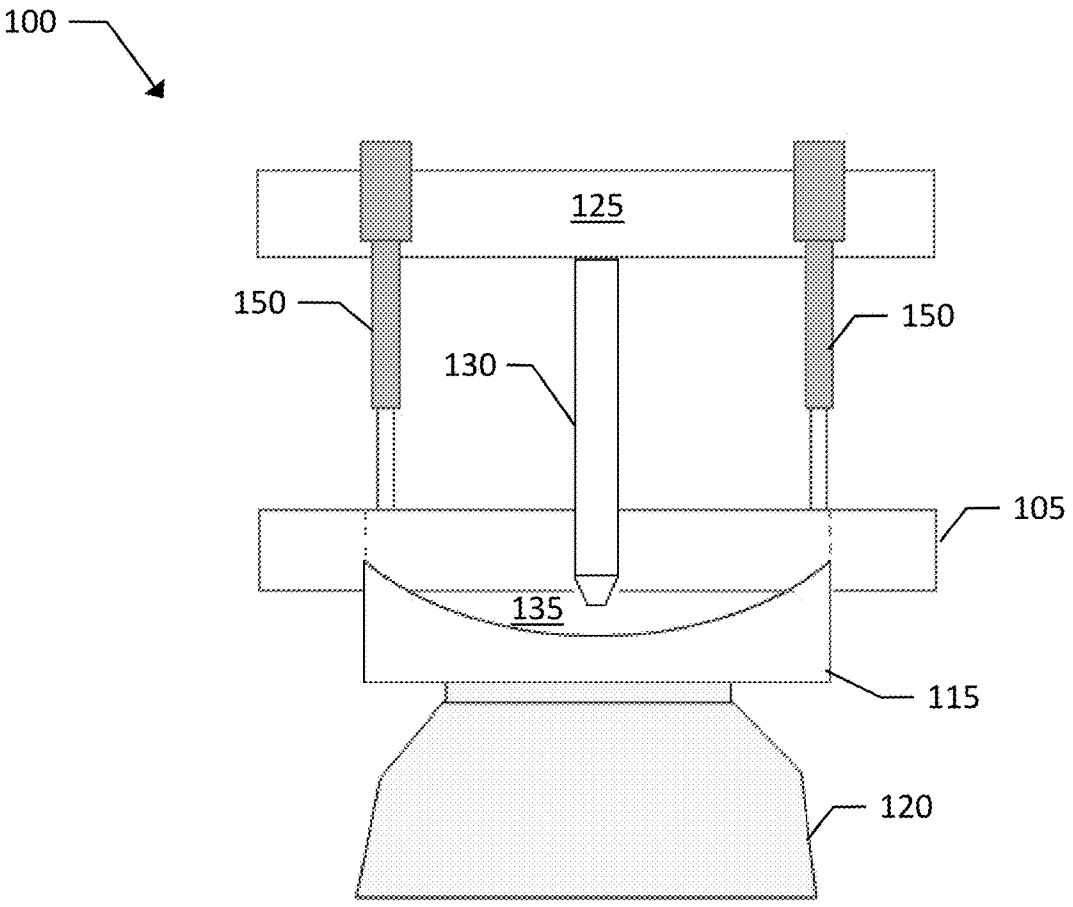
Figure 4:
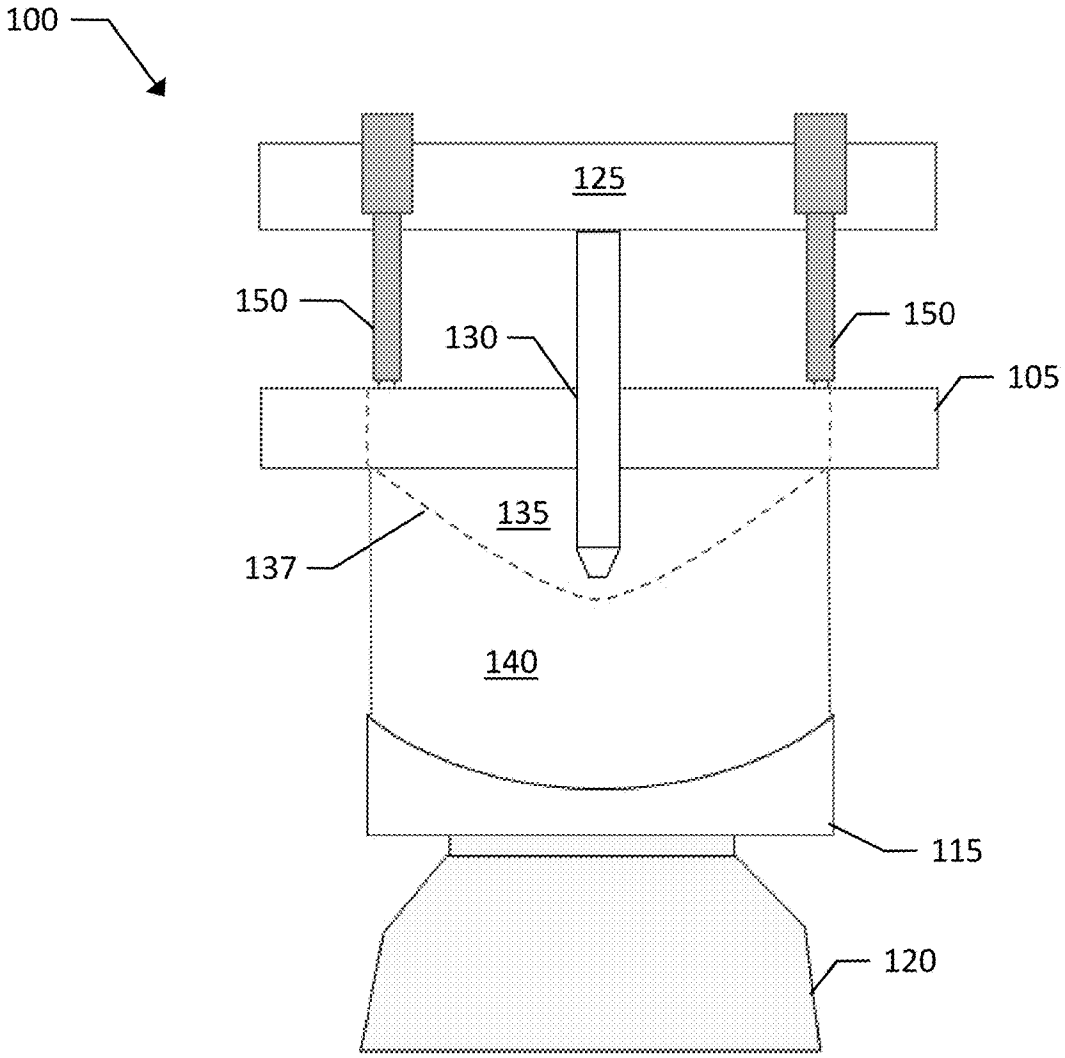
Figure 5:
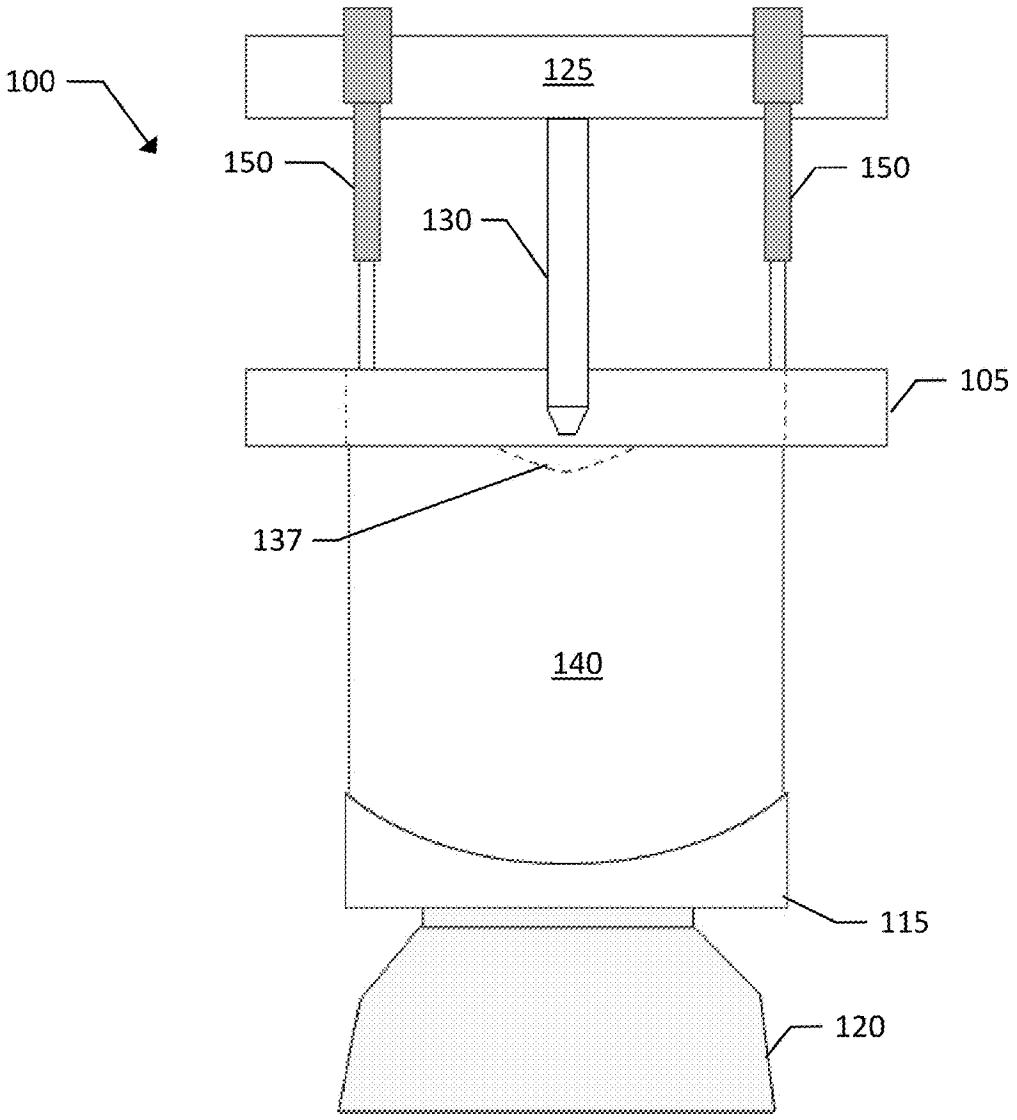
Figure 6:
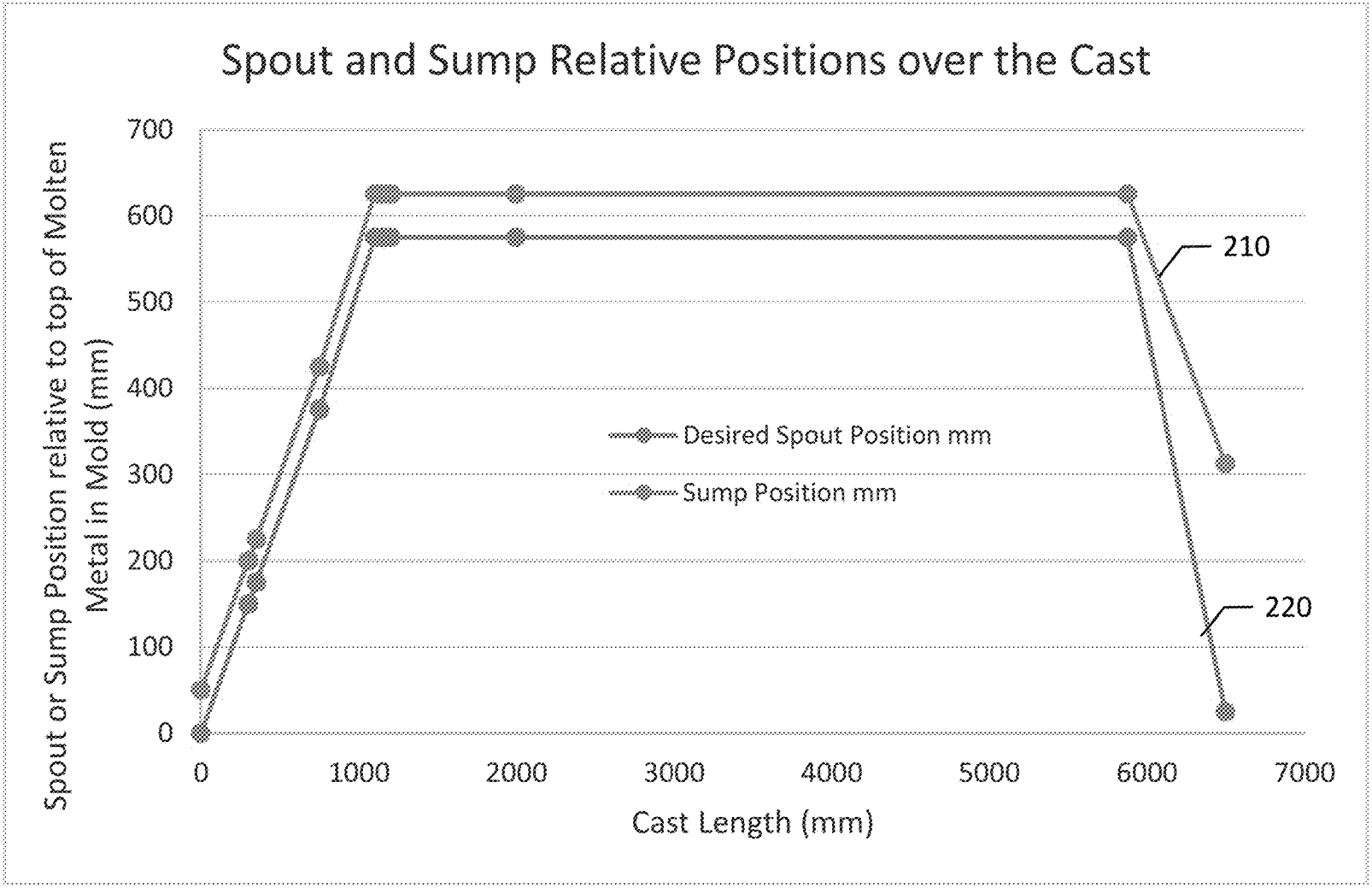
Figure 7:
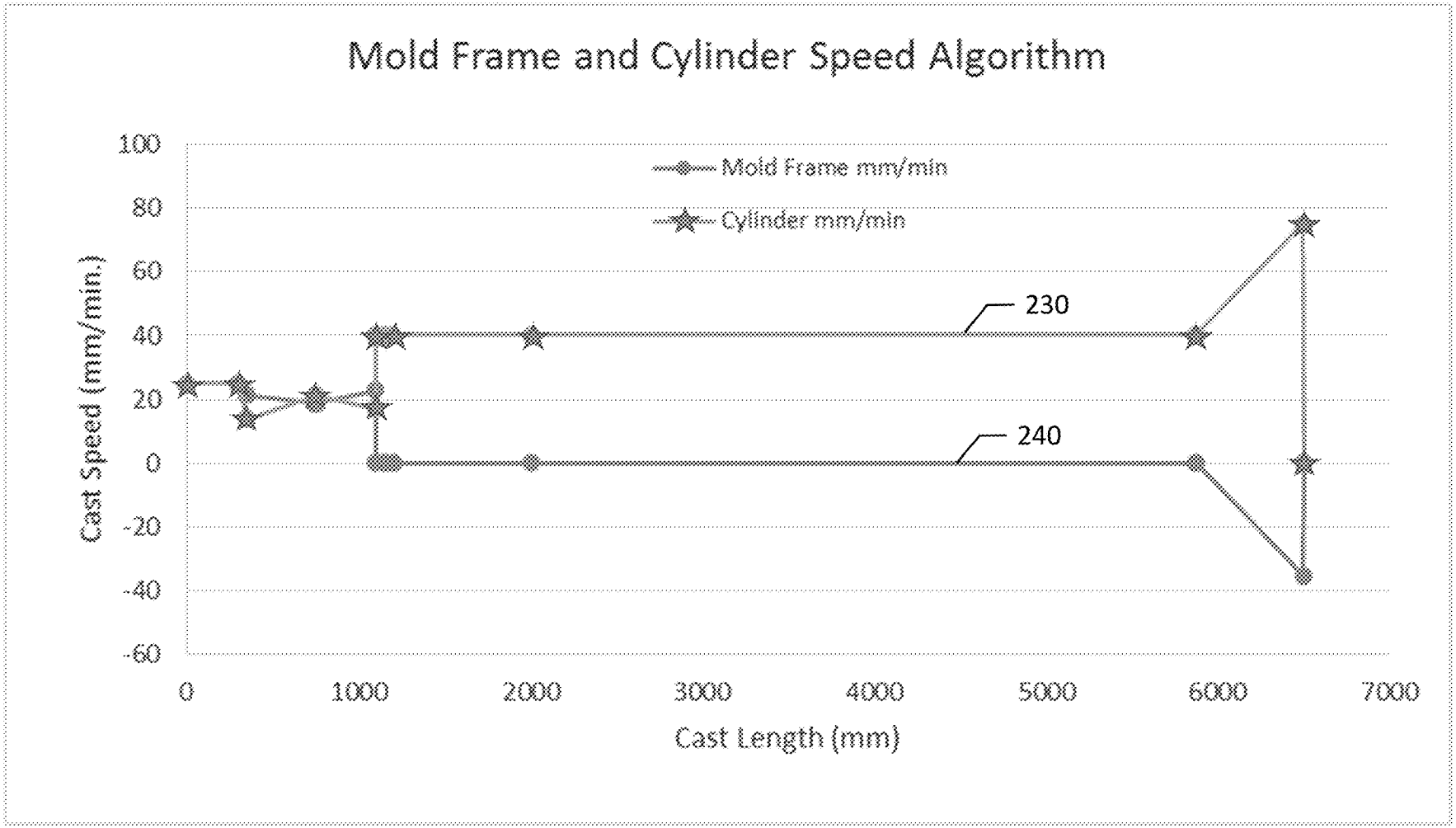
Figure 8:
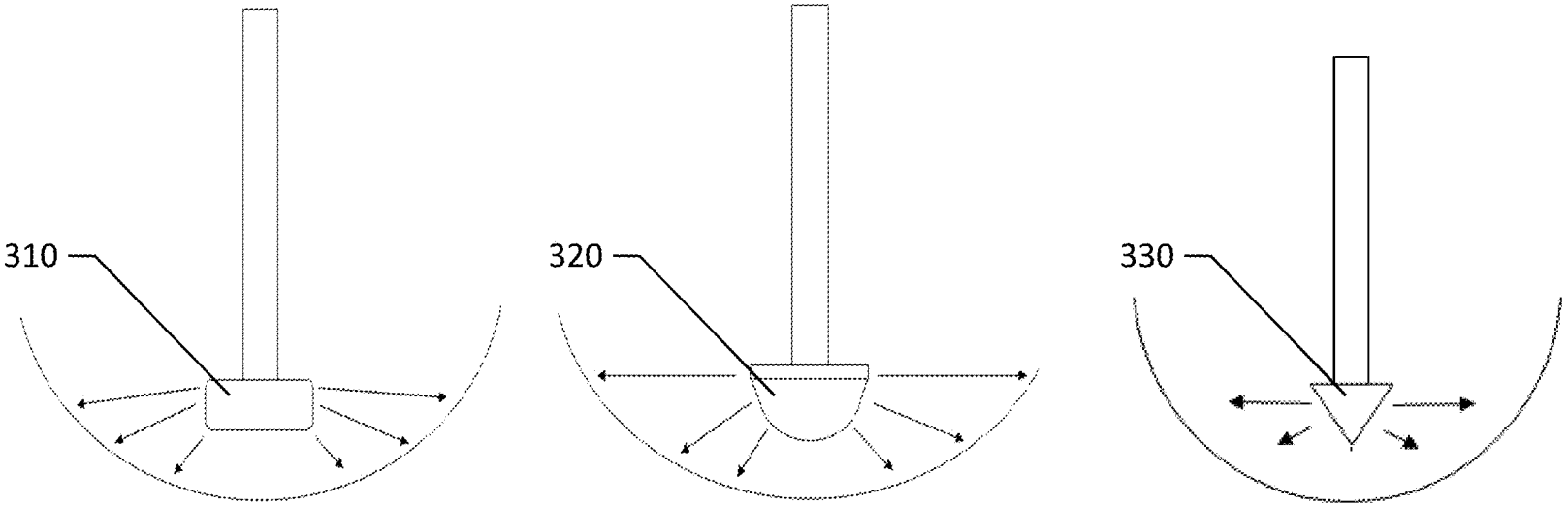
Figure 9:
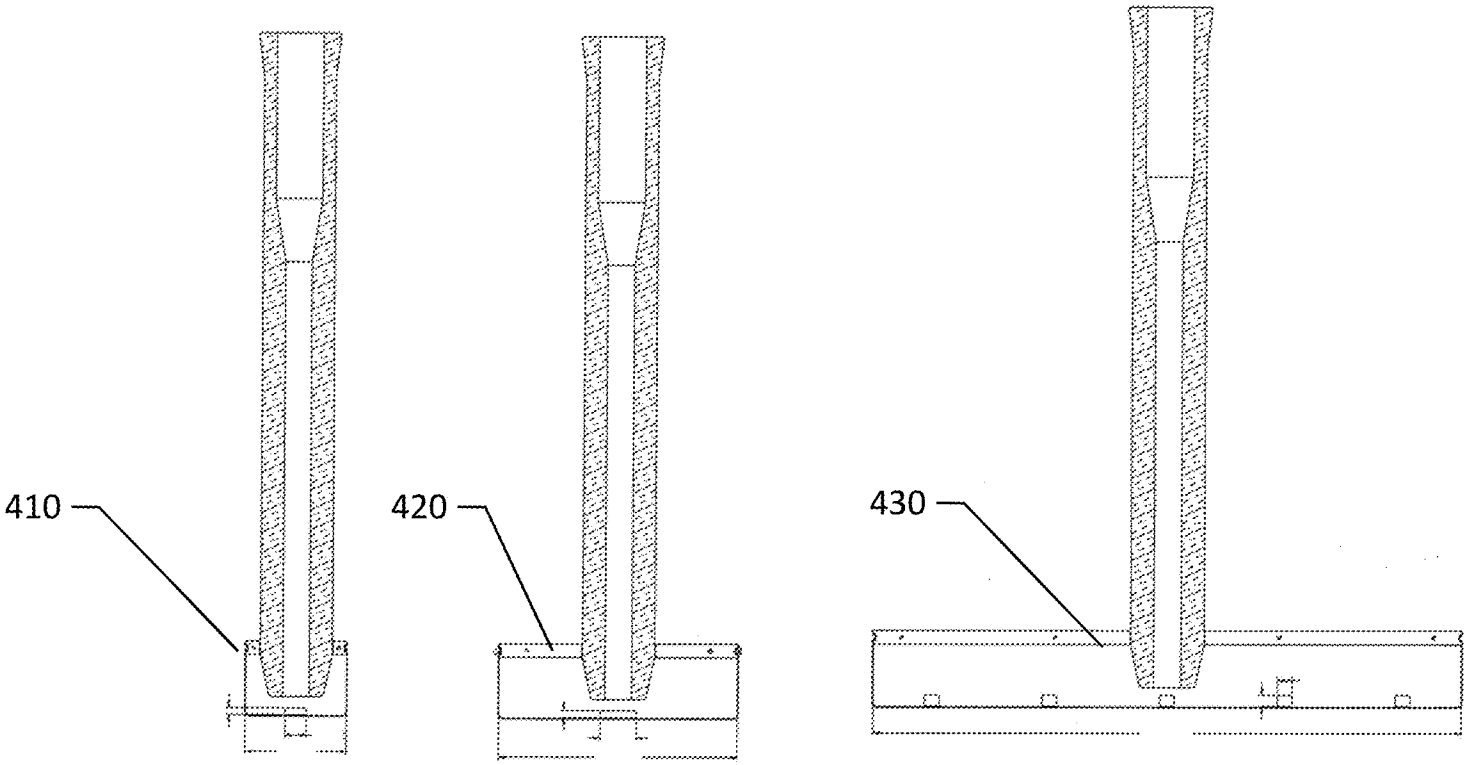

Having thus described the invention in general terms, reference will now be made to the accompanying drawings, which are not necessarily drawn to scale, and wherein:

FIG. 1 depicts a cross-section view of direct chill casting in process according to the prior art;

FIG. 2 illustrates a cross-section view of casting using a dynamically positionable diffuser at the start of a casting process according to an example embodiment of the present invention;

FIG. 3 illustrates a cross-section view of casting using a dynamically positionable diffuser during the startup phase of a casting process according to an example embodiment of the present invention;

FIG. 4 illustrates a cross-section view of casting using a dynamically positionable diffuser during steady-state casting of a casting process according to an example embodiment of the present invention;

FIG. 5 illustrates a cross-section view of casting using a dynamically positionable diffuser at the end of a casting process according to an example embodiment of the present invention;

FIG. 6 illustrates a graph of the spout or diffuser and sump positions during the casting process according to an example embodiment of the present invention;

FIG. 7 illustrates a graph of the speed of adjustment of cylinder and mold frame relative to the overall cast length of the ingot being poured according to an example embodiment of the present invention;

FIG. 8 depicts three diffusers each having a different shape according to an example embodiment of the present invention; and FIG. 9 depicts three diffusers each having a different size according to an example embodiment of the present invention.

DETAILED DESCRIPTION

Exemplary embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention generally relate to a method, apparatus, and system for metal distribution in a continuous casting mold cavity. Embodiments described herein may be particularly beneficial in vertical direct chill casting; however, embodiments may be used in a variety of different casting applications. Vertical direct chill casting is a process used to produce ingots or billets that may have small or large cross sections for use in a variety of manufacturing applications. The process of vertical direct chill casting begins with a horizontal table containing one or more vertically-oriented mold cavities disposed therein. Each of the mold cavities is initially closed at the bottom with a starting block to seal the mold cavity. Molten metal is introduced to each mold cavity through a metal distribution system to fill the mold cavities. As the molten metal proximate the bottom of the mold, adjacent to the starting block solidifies, the starting block is moved vertically downward along a linear path. The movement of the starting block may be caused by a hydraulically-lowered platform to which the starting block is attached. The movement of the starting block vertically downward draws the solidified metal from the mold cavity while additional molten metal is introduced into the mold cavities. Once started, this process moves at a relatively steady-state speed for a semi-continuous casting process that forms a metal ingot having a profile defined by the mold cavity, and a height defined by the depth to which the platform and starting block are moved.

During the casting process, coolant may be sprayed proximate the exit of the mold cavity to encourage solidification of the metal shell as the metal exits the mold cavity and the starting block is advanced downward. The cooling fluid is introduced to the surface of the metal from proximate the mold cavity as it is cast to draw heat from the cast metal ingot and to solidify the molten metal within the now-solidified shell of the ingot. As the starting block is advanced downward, the cooling fluid may be sprayed directly on the ingot to cool.

The direct chill casting process enables ingots to be cast of a wide variety of sizes and lengths, along with various profile shapes. While circular billet and rectangular ingot are most common, other profile shapes are possible.

Various complexities exist in the casting of metal parts, particularly in vertical direct chill continuous casting, including the manner in which metal is distributed within a mold cavity. Metal alloys generally include elements in addition to a pure metal component. These elements are ideally evenly combined in solution to provide a consistent metal alloy composition throughout a metal object, such as an ingot or billet. When in solid form, the elements are in fixed concentrations that do not migrate.

Due to a combination of effects from solute redistribution and shrinkage during solidification of a metal alloy from a liquid, thermal-solutal convection, dendrite fragmentation, and grain migration along a solidification front, where the liquid turns solid, may produce a variation in chemistry from the outer surface of an ingot or billet to a center of the ingot or billet. This variation in chemistry is known as macrosegregation. This macrosegregation is undesirable as the chemistry variation between portions of the metal can lead to unsatisfactory properties affecting the quality of materials produced from the ingot or billet.

Embodiments of the present invention provide a method, apparatus, and system to minimize macrosegregation and improve the quality and consistency of a cast metal object, such as an ingot or billet. Embodiments described herein provide a unique metal distribution system developed to allow feeding of liquid metal near the metal coherency point to solidus region (colloquially known as the "mushy zone") of a metal object, such as an ingot or billet, as the object is cast and throughout the entire casting process. The boundary region between 100% liquid and the coherency point temperature (the point at which solidification begins to occur through crystalline structure, grains start to coalesce to develop strength) is commonly referred to as the "slurry zone". Embodiments described herein reduce the accumulation of fragmented grains at the ingot center through metal distribution in the sump to reduce macrosegregation. An automated system may move the mold frame (including the mold cavity or cavities) relative to the metal distribution spout to maintain the spout at the correct metal depth (constant at solidification front) from the start-up phase of the casting to the end phase of the casting. A thermocouple disposed proximate the tip of the spout, which may be integrated with the spout, may provide feedback to a controller to determine the appropriate position of the mold cavity and the pool of molten metal therein relative to the spout tip. This appropriate position may vary depending upon the material being cast as temperature profiles may vary substantially among different alloys or metals.

Systems of example embodiments may include a range of unique metal diffusers/distributors, described further below, to provide the optimum metal flow during distribution in the sump and control algorithms to create the optimal flow conditions for manipulating the typical metal flow field and reduce macrosegregation.

Typical metal distribution systems for a casting mold include a spout and ceramic cloth metal distribution bag that feeds metal just under the surface of the liquid metal in direct chill molds due to the typical fixed constraints of the spout and mold position necessary for the start-up phase of casting. For any direct chill cast ingot, regardless of shape, feeding molten metal from a location near the surface (e.g., within about six inches of the surface), as with the traditional spout and ceramic cloth distribution bag system, may result in some degree of macrosegregation. Incoming metal is swept at its highest rate along the solidification front (e.g., at coherency temperature) towards the center of the ingot fragmenting first forming grains which are solute lean and dumping them at the bottom of the sump. This results in negative segregation formation in the center of the ingot in direct chill casting. Embodiments described herein provide a metal distribution system with automated control for feeding the metal from the distributor within the sump bottom region to decrease the speed in the natural convection cells and reduce the accumulation of solute lean grains at the sump location, thereby reducing macrosegregation.

FIG. 1 depicts a general illustration of a cross-section of a direct chill casting mold 100 during the casting process. The illustrated mold could be for a billet or an ingot, for example. As shown, the mold walls 105 form a mold cavity from which the cast part 110 is formed. The casting process begins with the starter block 115 sealing the bottom of the mold cavity against mold walls 105. As the platform 120 moves down along arrow 145 into a casting pit and the cast part begins to solidify at its edges within the mold walls 105, the cast part 110 exits the mold cavity. Metal flows from pouring trough 125, which may be a heated reservoir or a reservoir fed from a kiln, for example, through spout 130 into the mold cavity. As shown, the spout 130 is partially submerged within a molten pool of metal 135 to avoid oxidation of metal that would occur if fed from above the molten metal pool 135. The solidified metal 140 constitutes the formed cast part, such as an ingot. Flow through the spout 130 is controlled within the pouring trough 125, such as by a tapered plug fitting within an orifice connecting a cavity of the pouring trough 125 with a flow channel through the spout 130. Conventionally, the pouring trough 125, spout 130, and mold cavity/mold walls 105 are held in a fixed relationship from the beginning of the casting operation through the end of the casting operation. Flow of metal through the spout 130 continues as the platform 120 continues to descend along arrow 145 into the casting pit. When the casting operation is to end, either by the platform being at the bottom of its travel, the metal supply running low, or the cast part reaching the completed size, the flow of metal through the spout 130 stops, and the spout assembled on the trough is removed from the molten pool of metal 135 to allow the molten pool to solidify and complete the cast part.

Using the method illustrated in FIG. 1, macrosegregation formation is not controlled, and the cast part formed through the embodiment of FIG. 1 may not have a satisfactory composition consistency across the cross section throughout the cast part. Embodiments described herein minimize macrosegregation and help ensure metal composition consistency throughout a cast part.

FIG. 2 illustrates an example embodiment of the present invention including a mold 105 positioned using actuators 150, which may be linear actuators, worm gears, solenoids, acme threads, ball screws, cables, hydraulic pistons, or any other type of mechanism that can be used to move and hold the mold 105 relative to the trough 125 and spout 130. The mold 105 may be supported by a mold frame (not shown), where the actuators may be attached to the mold or mold frame for controlling the relative location of the mold. An automated control system, such as a programmable logic controller (PLC) may be connected to the actuator to position the mold frame and mold 105 relative to the trough 125 and spout 130 based upon pre-programmed practices and/or upon active measurements of the cast part as it is formed. The measurements may be of casting temperature, such as temperature of the metal from the spout 130 or of the cast part as it exits the mold 105, metal temperature around the spout tip inside the sump, the speed at which the platform 120 is descending, the flow rate of the metal through the spout 130, or any other parameters that influence the casting process. The illustrated embodiment of FIG. 2 includes a starting position where the tip of the spout 130 is positioned proximate the starter block 115 which is supported by the platform 120. The actuators 150 ensure the location during start up, where the start-up position may be a pre-programed position of the spout 130 relative to the starter block 115 and mold 105 that may be dependent upon the material to be cast, the starter block 115 profile, the mold 105 profile, or the like.

According to an example embodiment, the spout 130 may include one or more thermocouples to determine temperature of the spout 130 at one or more locations along its length, and in particular at the tip of the spout 130 where the metal exits the spout 130 from the trough 125. The thermocouple may determine the temperature of the liquid metal at the location of the spout 130 tip in the sump. Embodiments described herein may include metal distributors or diffusers at the spout 130 tip, which may be configured to include one or more thermocouples to provide a temperature of the metal flowing through the diffuser/distributor and/or the temperature of the metal around the diffuser/distributor in the sump. Temperature feedback from proximate the tip of the spout 130 or the attached diffuser may enable active control of the position of the spout or diffuser within the pool of molten metal to adjust to changes in metal temperature, oxide generation, or other casting conditions that may require unplanned movement of the mold 105 relative to the spout 130 to appropriately position the tip of the spout or the diffuser within the sump (e.g., the area of transition between the molten metal and the solid metal). The spout 130 of example embodiments is of a length that can accommodate such positional changes within the pool of molten metal to enable positioning of the tip proximate the sump as deemed desirable.

The spout 130 of example embodiments may be outfitted with specially defined diffusers at the tip of the spout to reduce metal splash at the cast start and to optimize metal distribution during the casting process. These diffusers could be separate parts assembled on the spout 130. The geometry of such diffusers could be triangular, rectangular, or other irregular shapes to accommodate different sizes of cast parts and molten liquid feeding directions and speeds. These diffusers can be made of any known refractory materials such as fiberglass cloth, fiber reinforced ceramics, or one of the various types of thermal ceramics or elevated temperature super alloys. Example embodiments of such diffusers are illustrated and described below.

According to example embodiments described herein, a casting specification may be entered into a programmable logic controller to control the position of a mold frame (otherwise known as a "mold table") to which one or more molds may be attached. The programmable logic controller is used according to example embodiments to control the position of the mold frame (and the molds held therein) with respect to the spout. While the example embodiment of FIG. 2 illustrates linear actuators that move the mold 105 and mold frame relative to the spout 130, example embodiments may optionally move the pouring trough 125 and spout 130 relative to the mold 105. Still further, the mold may be movable within the mold frame to enable the movement between the mold 105 and the spout 130 to be obtained by virtue of the mold 105 changing position within the mold frame. Regardless of how the movement is achieved, embodiments described herein provide a method of moving the spout 130 relative to the mold 105 to achieve the benefits of the invention described herein.

At the start of a cast, the mold 105 and mold frame may be positioned low enough relative to the spout 130 to clear the metal distributor spout 130. FIG. 2 illustrates such an example embodiment of the start of a cast. As the cast starts, the mold frame will rise, while the cast part casts out of the bottom of the mold. FIG. 3 illustrates such an embodiment where the starter block 115 is moving from the mold cavity of the mold 105. The mold frame will follow a specific programmed movement to maintain the spout 130 at the desired position relative to the solidifying molten pool. Example embodiments may include a thermocouple integrated into the casting spout to provide active feedback such that automatic adjustment of the spout 130 relative to the molten pool may be performed, such as when upstream metal temperature control (upstream of the trough 125) is variable which may result in the spout 130 tip or distributor freezing into the sump or other emergency situations. FIG. 3 may be during the start-up phase of casting during the transition from the start of the casting process but before the steady-state casting where temperature profiles of the molten metal and the speed of the casting becomes steady.

FIG. 4 illustrates the run-state phase of the casting process, where the mold 105 is positioned close to the spout 130 to engage the tip of the spout in the sump of the molten pool 135, where the dashed line 137 defines the transition between the liquid metal 135 and the solidified metal 140. At the end of the casting, as shown in FIG. 5, the actuators 150 move the mold 105 relative to the spout 130 to ensure the tip of the spout/diffuser does not get frozen into the cast metal. The programmable logic controller controls the system according to a programmed specification locating the mold 105 and the cast part positions relative to the spout 130 to obtain the relative cast speed necessary for the start and run portions of the cast, while maintaining the desired spout position relative to the bottom of the liquid pool. This unique balance positively influences metal distribution and reduces macrosegregation.

FIG. 6 illustrates a plot of desired spout/diffuser position relative to the sump position where the cast material is transitioning from a liquid to a solid with coherency. The sump position is illustrated as line 210, while the spout tip position is illustrated as line 220. As shown, at the beginning of the cast, where cast length is near zero, the sump position is at approximately 50 millimeters deep relative to the top of the pool of molten metal. The tip of the spout/diffuser at this phase is at about the same level as the top of the pool of molten metal. As the casting process begins and the cast part length grows (shown on the x-axis), the sump position becomes deeper into the cast part, going from about 50 millimeters at the beginning to about 620 millimeters once the cast part has reached a length of about 1,000 millimeters or 1 meter. According to the illustrated embodiment of FIG. 6, this is where run state casting begins and where the depth of the sump remains constant or near constant at about 620 millimeters. At this depth, the desired spout tip position is approximately 580 millimeters, or hovering 40 millimeters above the sump position where the liquid metal is solidified into coherent solid. Conventional casting methods are unable to distribute liquid metal at this depth, much less move the move the mold to position the spout tip according to the location of the sump.

As the casting process nears the end of the casting run, the sump becomes more shallow, and the mold shifts down having the relative effect of raising the spout relative to the mold. The spout tip position in the molten pool rises considerably at the end of the casting process relative to the sump as the mold and cylinder are lowered. Pouring of the metal is ceased and the spout is withdrawn to allow the molten metal to solidify. FIG. 6 illustrates one example embodiment of a spout position relative to a sump position over a cast, and is unique to the alloy being cast, casting speed, and the size and shape of the mold, among other variables that influence the casting process.

A special control algorithm is determined that is unique for each alloy and cast part size combination. The algorithm may link the typical heat balance with the spout positioning requirements to ensure that the spout/distributor remains close to the coherency point temperature at the bottom of the sump of a cast product for the duration of the cast. An example illustration of the control algorithm is illustrated in FIG. 7, which depicts the mold frame speed as line 230, and the "cylinder speed" or the platform descent speed as line 240 which may be produced by the movement of a hydraulic cylinder in the casting pit. As illustrated, the cylinder speed begins at a specified rate and slows, before accelerating and then achieving a steady-state speed of approximately 40 millimeters per minute during steady state in this example. The mold frame rate, or the rate at which the spout is moved relative to the mold, regardless of mechanism to provide the relative movement, is initially similar to that of the cylinder speed, but once steady state casting is achieved, becomes a speed of zero, as the spout is maintained in a constant position relative to the mold during the steady state casting of the cast part, shown in FIG. 4. Proximate the end of the casting operation, the pouring of molten metal through the spout ceases, and the mold is lowered allowing the spout to withdraw from the molten pool, while the cylinder speed increases, before both stop movement at the end of the cast. In certain applications of this process, the cylinder speed may also be decreased at the end of cast to reduce the shrinkage cavity before cast end is reached.

While control algorithms may be developed for each alloy and cast part size, the thermocouple of the tip of the spout/diffuser may provide feedback of temperatures not anticipated during a standard or ideal casting operation, or to confirm operation is proceeding as anticipated. In such an embodiment, the control algorithm may use the temperature feedback from the spout tip to adjust the position of the spout relative to the sump as necessary, and to locate the spout tip appropriately given the temperature anomalies observed. This may provide a reliable consistency of material across the cross section of the material, even when casting conditions are not ideal or if there is an issue encountered during casting that can be rectified by repositioning of the mold and sump relative to the spout location.

The spout 130 and spout tip described herein and illustrated above provide a spout with no specific geometric characteristics, embodiments described herein may include diffusers at the tip of the spout to promote desired metal flow within the sump. Different metal alloys and different casting sizes may have different properties which benefit from distinct metal flow patterns in the sump. FIG. 8 illustrates a square or rectangular diffuser 310, an oval or partial sphere or sump-shaped diffuser 320, and a triangular diffuser 330. The arrows represent the potential metal feeding directions associated with each of the illustrated diffusers. Each of these configurations in addition to various other diffusers may be used in combination with examples described herein to mitigate macrosegregation by providing counter-current flow.

In addition to different shapes, the profile, diffuser orifices (openings) and size of the diffusers may be altered as desired to achieve optimum flow of metal within the sump. FIG. 9 illustrates three rectangular diffusers of different lengths, with a short diffuser 410, a medium length diffuser 420, and a long diffuser 430. Further, each of the diffusers of FIG. 9 could have an end profile shape as illustrated in FIG. 8 to promote flow as desired. The diffusers may have a number of different orifices through which metal flows during casting. The diffuser size and number and sizes of open orifices may be varied according to the cast part size and the alloy type. The assembly of the rectangular metal diffuser may include two portions: a top portion which may be two pieces of rigid ceramic material attached to the spout; and a bottom portion having localized open orifices to optimize metal flow. Various materials for the bottom part may be used, such as fiberglass cloth, fiber reinforced ceramics, thermal ceramics, or elevated temperature super alloys. In the case of fiberglass cloth, the cloth can be attached to the top part into a groove using refractory clamps, and/or high temperature metal parts or wires, for example.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method comprising:

receiving an indication of a material to be cast in a cavity of a mold;

establishing, from the indication of the material type, temperature information associated with the material type;

dispensing the material in liquid form through a diffuser into the cavity of the mold;

detecting a temperature at a tip of the diffuser within the cavity of the mold; and moving at least one of the diffuser or the mold relative to the other responsive to the temperature at the tip of the diffuser to maintain the tip of the diffuser within a pool of the material in liquid form based on a predefined temperature range associated with the temperature information.

2. The method of claim 1, wherein moving at least one of the diffuser or the mold relative to the other responsive to the temperature at the tip of the diffuser to maintain the tip of the diffuser within a pool of the material in liquid form based on a predefined temperature range associated with the temperature information comprises moving at least one of the diffuser or the mold relative to the other responsive to the temperature at the tip of the diffuser to maintain the tip of the diffuser within a pool of the material in liquid form at a predefined distance from the coherency point of the material.

3. The method of claim 1, further comprising:

controlling a flow of the material through the diffuser in response to one or more properties of the pool of material.

4. The method of claim 1, further comprising:

determining, based on the material type, an initial position of the diffuser relative to the cavity of the mold; and moving at least one of the diffuser or the mold relative to the other to the initial position before dispensing material though the diffuser.

5. The method of claim 4, further comprising:

moving at least one of the diffuser or the mold relative to the other from the initial position to a secondary position based on an algorithm associated with the material type after the material has started to be dispensed from the diffuser and casting is occurring at a steady state.

6. The method of claim 5, further comprising:

moving at least one of the diffuser or the mold relative to the other from the secondary position to a tertiary position based on the algorithm associated with the material type in response to an indication that the casting is ending.

7. The method of claim 1, wherein the mold is a direct chill mold comprising a starting block, the method further comprising:

moving the starting block relative to the mold cavity and the diffuser.

8. The method of claim 1, wherein moving at least one of the diffuser or the mold relative to the other is performed by an actuator controlled by a controller, wherein the controller receives the temperature at the tip from a thermocouple and moves the at least one of the diffuser or the mold relative to the other responsive to the temperature at the tip of the diffuser.

9. An apparatus for liquid metal distribution into a continuous casting mold cavity, said apparatus comprising:

a continuous casting mold frame supporting a mold defining a continuous casting mold cavity;

a liquid diffuser comprising a tip;

at least one temperature sensor configured to detect a temperature at the tip of the liquid diffuser;

an actuator configured to move at least one of the continuous casting mold frame and the liquid diffuser relative to one another; and a controller, wherein the controller is configured to:

receive an indication of a material to be cast in the continuous casting mold cavity and temperature information associated with the material; and control movement of the actuator to move at least one of the continuous casting mold frame and the liquid diffuser relative to one another in response to a temperature signal from the at least one sensor to maintain the tip of the diffuser within a pool of the material in liquid form based on a predefined temperature range associated with the temperature information.

10. The apparatus of claim 9, wherein the at least one sensor comprises a thermocouple, and the signal from the at least one sensor comprises a temperature at the tip of the diffuser.

11. The apparatus of claim 9, wherein the controller is further configured to control flow of the material through the diffuser in response to one or more properties of the pool of material.

12. The apparatus of claim 9, wherein the controller is configured to maintain the tip of the diffuser within the pool of the material in liquid form at a predefined distance from the coherency point during casting.

13. The apparatus of claim 9, wherein the controller is further configured to:

determine, based on the material type, an initial position of the diffuser relative to the cavity of the mold; and control movement of the actuator to move at least one of the diffuser or the mold relative to the other to the initial position before dispensing the material though the diffuser.

14. The apparatus of claim 13, wherein the controller is further configured to:

control movement of the actuator to move at least one of the diffuser or the mold relative to the other from the initial position to a secondary position based on an algorithm associated with the material type after the material has started to be dispensed from the diffuser and casting is occurring at a steady state.

15. A method comprising:

receiving an indication of a material to be cast in a cavity of a mold;

establishing, from the indication of the material type, temperature information associated with the material type;

dispensing the material in liquid form through a diffuser into the cavity of the mold;

detecting a temperature at a tip of the diffuser within the cavity of the mold; and maintaining a position of the tip of the diffuser within a pool of the material in liquid form at a predetermined distance from a coherency point of the material.

16. The method of claim 15, wherein maintaining a position of the tip of the diffuser within a pool of the material in liquid form at a predetermined distance from a coherency point of the material is performed based on the temperature at the tip of the diffuser.

17. The method of claim 15, further comprising:

determining, based on the material type, an initial position of the diffuser relative to the cavity of the mold; and moving at least one of the diffuser or the mold relative to the other to the initial position before dispensing material though the diffuser.

18. The method of claim 17, further comprising:

moving at least one of the diffuser or the mold relative to the other from the initial position to a secondary position based on an algorithm associated with the material type after the material has started to be dispensed from the diffuser and casting is occurring at a steady state.

19. The method of claim 18, further comprising:

moving at least one of the diffuser or the mold relative to the other from the secondary position to a tertiary position based on the algorithm associated with the material type in response to an indication that the casting is ending.

20. The method of claim 15, wherein maintaining a position of the tip of the diffuser within the pool of the material in liquid form at a predetermined distance from a coherency point of the material comprises maintaining a position of the tip of the diffuser within the pool of the material in liquid form based on the detected temperature at the tip of the diffuser.

* * * * *